US012661575B2

(12) United States Patent
Wank et al.

(10) Patent No.: US 12,661,575 B2
(45) **Date of Patent: *Jun. 23, 2026**

(54) CARD HOLDING AND PLAYING SYSTEM

(71) Applicant: Chick Magnets NY LLC, Scarsdale, NY (US)

(72) Inventors: Leslie Wank, Scarsdale, NY (US); Laura Koch, Scarsdale, NY (US); Mary Beth Kean, Goldens Bridge, NY (US)

(73) Assignee: Chick Magnets NY LLC, Scarsdale, NY (US)

( * ) Notice: Subject to any disclaimer, the term of this patent is extended or adjusted under 35 U.S.C. 154(b) by 750 days.

This patent is subject to a terminal disclaimer.

(21) Appl. No.: 18/089,836

(22) Filed: Dec. 28, 2022

(65) Prior Publication Data

US 2023/0137827 A1 May 4, 2023

Related U.S. Application Data

(63) Continuation-in-part of application No. 17/563,798, filed on Dec. 28, 2021, now Pat. No. 12,233,331.

(60) Provisional application No. 63/131,468, filed on Dec. 29, 2020.

(51) Int. Cl.
*A63F 1/10* (2006.01)

(52) U.S. Cl.
CPC ..... *A63F 1/10* (2013.01)

(58) Field of Classification Search
CPC ..... A63F 1/08; A63F 1/10
See application file for complete search history.

(56) References Cited

U.S. PATENT DOCUMENTS

| | | | | | |
|---|---|---|---|---|---|
| 1,673,825 | A * | 6/1928 | Hoffmann | A63F 1/10 | 248/349.1 |
| D158,870 | S * | 6/1950 | Koppelman | D21/392 | |
| 2,526,297 | A * | 10/1950 | Tendler | A63F 1/10 | 24/67.11 |
| D176,405 | S * | 12/1955 | Ericson | D21/392 | |
| 5,029,797 | A * | 7/1991 | Levorchick | A63F 1/10 | 248/459 |
| 2011/0095476 | A1* | 4/2011 | Avilla | A63F 1/08 | 273/148 A |

* cited by examiner

*Primary Examiner* — Michael D Dennis
(74) *Attorney, Agent, or Firm* — Bay State IP, LLC

(57) ABSTRACT

Certain aspects are directed to a portable and compact card holding and playing system comprising a card caddy with a detachable rotating mechanism, a flexible retaining device with at least one weighted element, a plurality of retaining discs, and a game plate using a number of flexible retaining mechanisms. The game plate is single and/or trifold with the trifold plate comprising a ferrous core with top and bottom laminate materials connected via hinges. The retaining disc is stackable, which can be placed on a number of cards or on each other. The card tray is preferably detachable from a base with a center divider that includes a magnetic component used to securely attach the card tray to the magnets embedded in the flexible retaining device and the base, thus allowing the kit to operate via magnetic and gravitational forces and be used in the presence of wind, turbulence or on uneven playing surfaces.

21 Claims, 24 Drawing Sheets

*Fig. 1A*
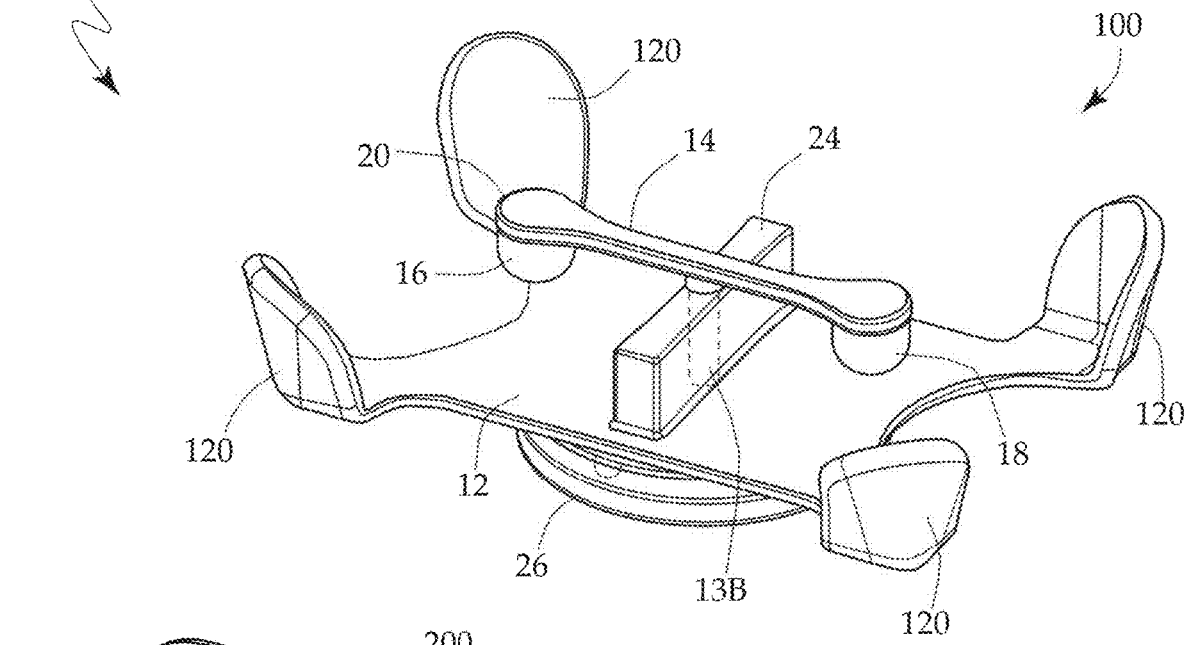
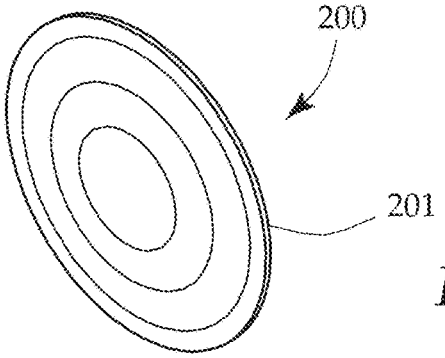
*Fig. 1B*
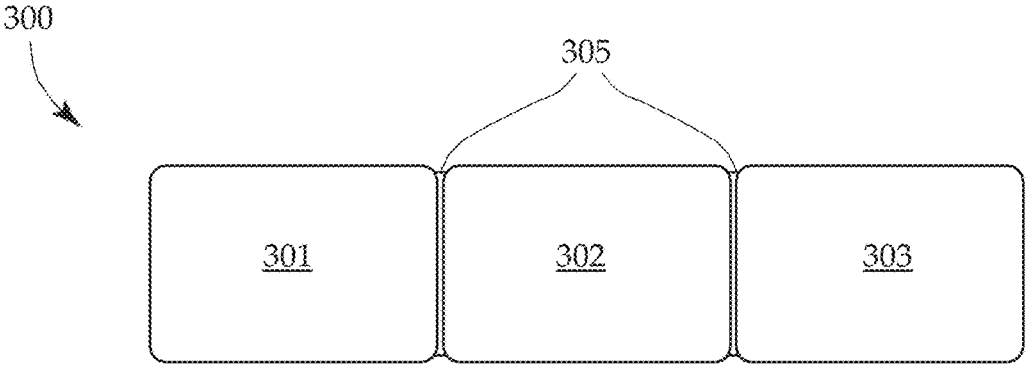
*Fig. 1C*

FIG. 15A
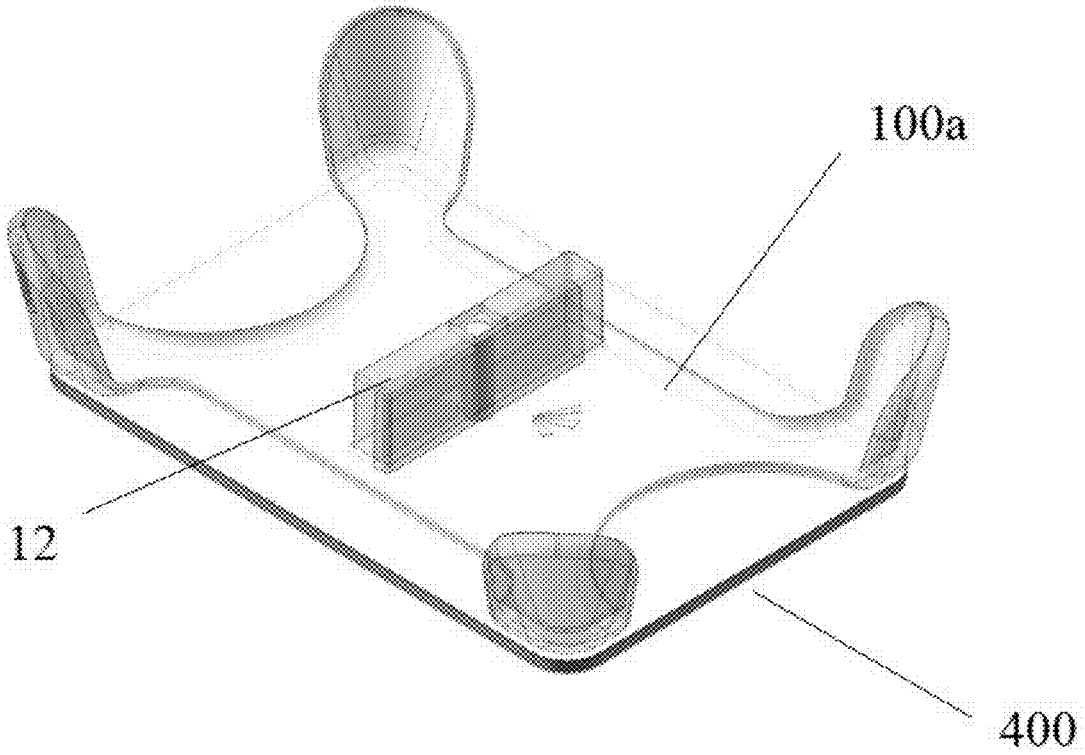
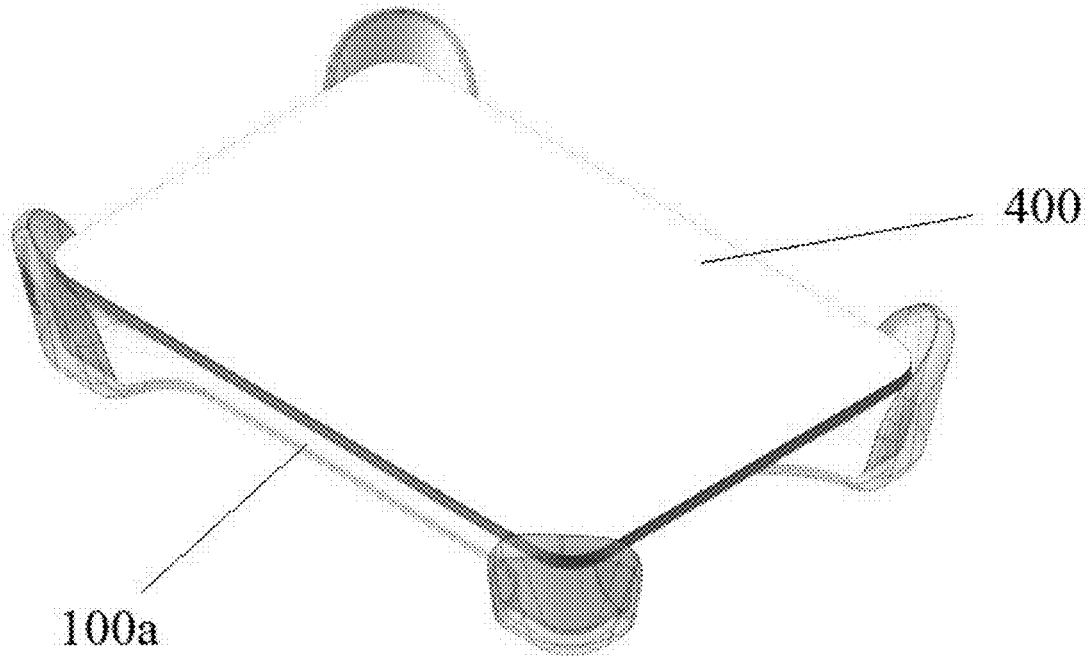
FIG. 15B

CARD HOLDING AND PLAYING SYSTEM

CROSS REFERENCE TO RELATED APPLICATION

This application is a continuation-in-part application and claims the benefit of and takes priority from U.S. patent application Ser. No. 17/563,798 filed on Dec. 28, 2021, which in claims the benefit of and takes priority from U.S. Provisional Patent Application Ser. No. 63/131,468 filed on Dec. 29, 2020, the contents of which are herein incorporated by reference.

BACKGROUND OF THE INVENTION

Field of the Invention

This invention relates to a card holding and playing system for holding down playing cards, whether in a fanned position or in stacked piles, and more particularly to a card holding and playing system that is both effective and practical by utilizing compact, low profile, lightweight, portable, and durable retaining devices with low and high friction elements that allow for one-handed, secure card play.

Description of the Related Art

Card games in various forms have been very popular for all kinds of occasions. However, holding down several cards, whether in a card caddy pick or draw pile and/or exposed on the table (e.g., the deal, melds, tricks, passed cards, discards, river) can be cumbersome if conditions such as wind, turbulence or an uneven playing surface are present. There have been attempts to control for wind with enhancements to the caddy and the development of magnetic or "wind-resistant" cards. However, this invention differs in offering a complete card playing solution that is both effective and practical as a compact, lightweight, portable, user-friendly kit that does not damage cards or require the expense of specialty cards which are difficult to shuffle, may rust, and are in limited supply. A flexible weighted retaining mechanism on this invention conforms to various card stack depths, whether one card or several, and then returns to its original shape, all without marking or denting the playing cards. A second retaining mechanism utilizes light magnetic forces to accomplish the same for smaller card stacks. This invention's card caddy has enough structure to hold cards while rotating, while also featuring a minimized design to create greater access in pulling or discarding playing cards.

SUMMARY OF THE INVENTION

The instant apparatus as illustrated herein, is clearly not anticipated, rendered obvious, or even present in any of the prior art mechanisms, either alone or in any combination thereof. Thus, the several embodiments of the instant apparatus are illustrated herein.

A primary object of the instant invention is to provide a card holding and playing system that utilizes a plurality of retaining devices for holding down and drawing cards which is effective, compact, lightweight, portable, and durable, and allows for one-handed, secure card play.

Another object of the instant invention is to provide a card holding and playing system which can be used to hold down one or more cards or card stacks in windy or turbulent conditions or on uneven playing surfaces by utilizing a first retaining device, namely the flexible retaining device, which is preferably symmetrical and includes a pair of weighted elements, with each one of the pair of weighted elements located at opposite ends of the flexible retaining device.

Another object of the instant invention is to provide a card holding and playing system which can be used to hold down one or more cards or card stacks in windy or turbulent conditions or on uneven playing surfaces by utilizing a second retaining device, namely the retaining disc, which is lightweight, slippery and contains a magnetic element to exert light magnetic forces onto a ferrous surface to allow for dealing, holding down, and arranging cards in a secure manner and without it being necessary to lift and reattach the retaining disc from the ferrous surface. Light magnetism and a low friction casing allow the retaining disc to easily slide over cards with gentle, one-handed pull/push manipulation, while an air gap at the retaining disc's edge allows cards to be easily inserted under the retaining disc while it remains attached to the ferrous surface. Light magnetism also enables quick clean-up, with the plurality of retaining discs naturally attracting into a compact vertical column.

Accordingly, certain aspects of the instant invention are directed to a card holding and playing system, which includes a card caddy comprised a card tray with a center divider and a base located under the card tray; a plurality of retaining devices, namely the flexible retaining device and the retaining disc; and one or more single or foldable game plates.

In another embodiment, the first and second retaining devices may be utilized for other purposes besides playing cards, for example to hold menus or napkins or paper plates or any paper pile as effective, lightweight, and portable "paper weights" to be used on ferrous surfaces.

In a preferred embodiment, the flexible retaining device comprises a weighted, spherical, low friction, substantially non-ferrous element that is partially exposed at both ends of the device allowing ease of card insertion and removal at multiple angles and with sufficient weight to hold down stacks of playing cards.

Additionally, the retaining disc is preferably configured to have a light magnetic element encased in the center of a slippery, heat resistant material with flat top and bottom surfaces for stacking several retaining discs and an air gap at its edge for allowing easy card insertion and removal.

Furthermore, the card tray offers a leaner solution for holding playing cards with its minimalist structure including a set of four corners, preferably bevelled in an outward orientation with openings wide enough to accommodate different card sizes and orientations, allowing ease of access to the cards, particularly in light of a flexible retaining device that lies centered above the card stacks.

In one embodiment, the card tray is made of durable, lightweight, and slippery material such as, but not limited to, polycarbonate, acrylic, and aluminium.

In one embodiment, the card tray and divider comprise a singular unit with the divider preferably containing a ferrous metal or magnetic rod at its center in order to receive attachable components of the system. In another embodiment, the divider may be removably attachable to the center of the card tray via a magnetic or friction fit mechanism with the base.

In one embodiment, the flexible retaining device is magnetic and detachable such that players may use the flexible retaining device on any ferrous surface to hold down one or more cards or card stacks. In other embodiments, the flexible retaining device may be removably or fixedly attached to surfaces via friction fit and/or snap fit mechanisms.

In one embodiment, the base is magnetic, detachable and adorned with artwork such that players may use the base separately with the first or second retaining device as a game plate or for other purposes entirely and may use the tray without a base.

In one embodiment, at least one ferrous plate is preferably a trifold plate secured with a silicone, vinyl, Tyvek, polypropylene, polyurethane, or other laminate material or combination of top and bottom laminate materials. Foldable and single plates have a top surface that is preferably slippery with a low coefficient of friction and a bottom surface that is grippy or layered with a grippy treatment, material, or other mechanism to prevent the plate from moving on a surface. The plates may be made of lightweight substantially ferrous metal that is galvanized or otherwise protected from rust.

There has thus been outlined, rather broadly, the more important features of card holding and playing kit, in order that the detailed description thereof that follows may be better understood, and in order that the present contribution to the art may be better appreciated. There are additional features of the system that will be described hereinafter and which will form the subject matter of the claims appended hereto.

In this respect, before explaining at least one embodiment of the system in detail, it is to be understood that the system is not limited in its application to the details of construction and to the arrangements of the components set forth in the following description, and/or illustrated in the drawings. The system is capable of other embodiments and of being practiced and carried out in various ways. Also, it is to be understood that the phraseology and terminology employed herein are for the purpose of description and should not be regarded as limiting.

These together with other objects of the system, along with the various features of novelty, which characterize the system, are pointed out with particularity in the claims annexed to and forming a part of this disclosure. For a better understanding of the system, its operating advantages and the specific objects attained by its uses, reference should be made to the accompanying drawings and descriptive matter in which there are illustrated preferred embodiments of the system.

The foregoing has outlined the more pertinent and important features of the present system in order that the detailed description of the system that follows may be better understood, and the present contributions to the art may be more fully appreciated. It is of course not possible to describe every conceivable combination of components and/or methodologies, but one of ordinary skill in the art may recognize that many further combinations or permutations are possible. Accordingly, the novel architecture described below is intended to embrace all such alterations, modifications, and variations that fall within the spirit and scope of the appended claims.

BRIEF DESCRIPTION OF THE DRAWINGS

The invention may be more completely understood in consideration of the following detailed description of various embodiments of the invention in connection with the accompanying drawings, in which:

FIGS. 1A-1C illustrates a schematic overview of the card holding and playing system showing a rotatable card caddy with a flexible retaining device, a plurality of retaining discs, and a set of game plates wherein the set of game plates may comprise a single game plate and/or folding game plates depending on need.

FIG. 15A-15B illustrate the card tray and base in both a "play" and "storage" position.

DETAILED DESCRIPTION OF THE SEVERAL EMBODIMENTS

Figure 2:
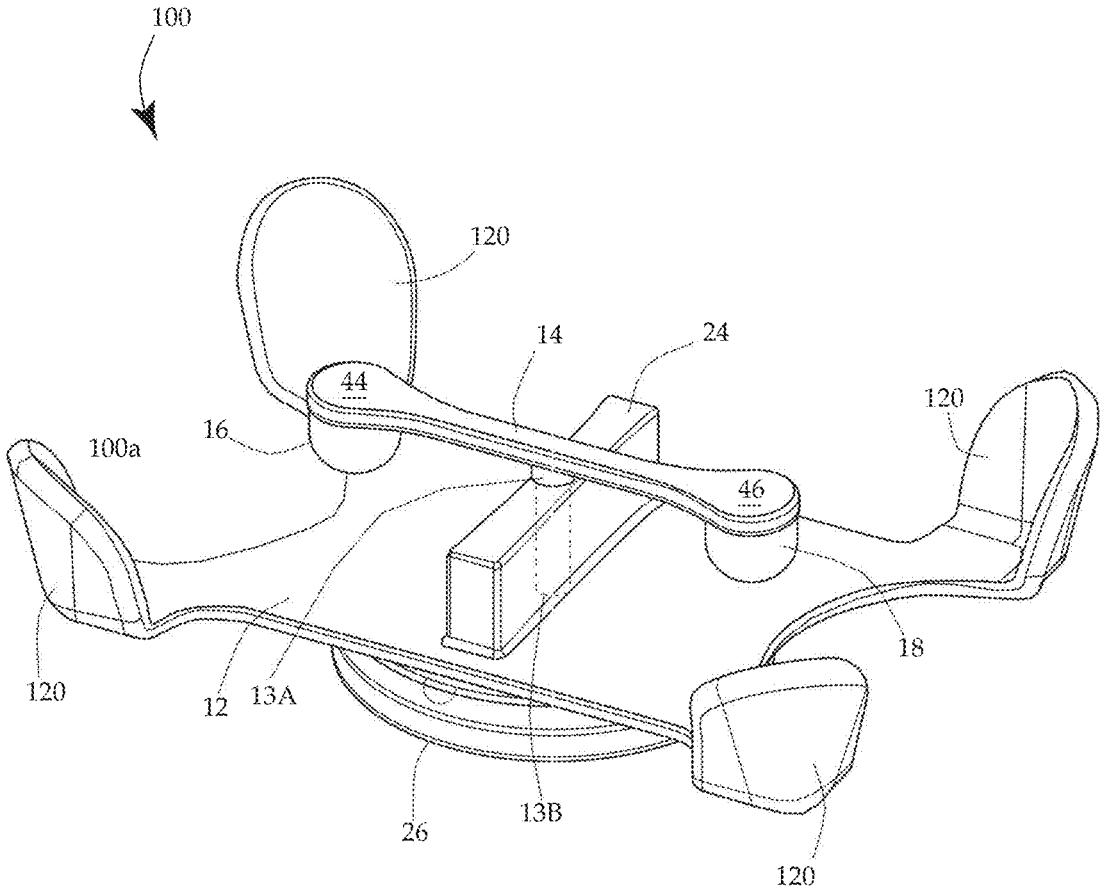
FIG. 2 is a schematic diagram showing the rotatable card caddy with the flexible retaining device to secure stacks of playing cards.

The detailed description set forth below in connection with the appended drawings is intended as a description of several embodiments of the apparatus and does not represent the only forms in which the present apparatus may be constructed and/or utilized. The description sets forth the functions and the sequence of steps for constructing and operating the apparatus in connection with the illustrated embodiments. However, it is to be understood that the same or equivalent functions and sequences may be accomplished by different embodiments that are also intended to be encompassed within the spirit and scope of the invention.

For the following defined terms, these definitions shall be applied, unless a different definition is given in the claims or elsewhere in this specification. All numeric values are herein assumed to be modified by the term "about", whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following description should be read with reference to the drawings wherein like reference numerals indicate like elements throughout the several views. The drawings, which are not necessarily to scale, depict illustrative embodiments of the claimed invention.

Reference will now be made to non-limiting embodiments, examples of which are illustrated in the Figures.

FIGS. 1A-1C illustrate a card holding and playing system 10, wherein the system 10 comprises a rotatable card caddy 100 with a flexible retaining device 14, a stackable retaining disc 200, and a plurality of foldable game plates 300. In a preferred embodiment, the foldable game plate 300 further comprises three multi-layered ferrous plates, 301, 302, 303, bonded by top and bottom laminate material with living hinges 305. In one embodiment, the system 10 includes one or more single game plates 320 with a ferrous core encased in a laminate material. In another embodiment, the ferrous core is powder coated, galvanized, plated, or painted and has a grippy material and/or coating on its underside.

Figure 3:
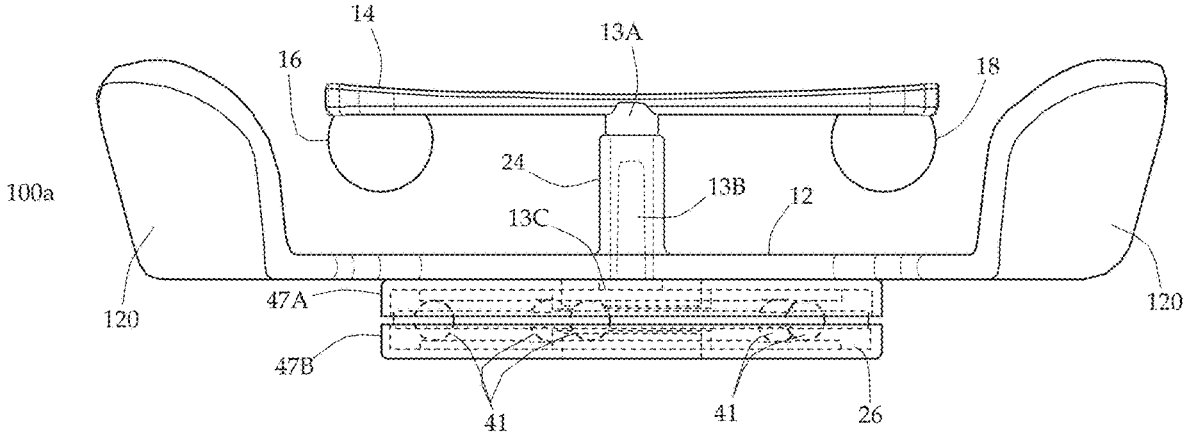
FIG. 3 is a schematic side view of the rotatable card caddy with the flexible retaining device.

FIGS. 2 and 3 illustrate a card tray 100*a* mounted on a base 26, wherein the base 26 may be rotatable in some embodiments and non-rotatable in other embodiments, with a flexible retaining device 14 that is preferably symmetrical and is configured to be removably attached to a divider 24 or a game plate 300 via magnet 13A located at the middle of the flexible retaining device 14. In a preferred embodiment, the card tray 100*a* comprises four corners 120, a flat surface 12, and a divider 24 centered on the flat surface 12 to accommodate two decks of cards. In one embodiment, the flexible retaining device 14 comprises a pair of weighted elements 16 and 18, wherein element 16 is secured at end 44 of the flexible retaining device 14 and element 18 is secured at end 46 of the flexible retaining device 14. In a preferred embodiment, elements 16 and 18 are substantially spherical and are made of low friction, weighted, non-ferrous material. In another embodiment, elements 16 and 18 are only partially exposed at the ends 44 and 46.

In one embodiment, the card tray 100*a* is made of highly polished polycarbonate and is sufficiently large to hold cards of different sizes. Alternatively, the card tray 100*a* may be made of metal, acrylic, plastic composite, or other material that is durable and lightweight.

In one embodiment, the rotatable card caddy 100 has a bottom with sufficient grip so that the caddy does not slide on a surface.

In one embodiment, a set of four corners 120 of the card tray 100*a* bevel out slightly to allow cards to slide in and out more easily. In addition, in one embodiment the base 26 comprises a top bearing plate 47A, a bottom bearing plate 47B, a magnet 13C located inside the top bearing plate 47A, and a plurality of steel balls 41 in between the bearing plates. In a preferred embodiment, the base 26 is rotatable and the flat surface 12 is attached to the top bearing plate 47A, wherein the flat surface 12 and the top bearing plate 47A swivel simultaneously on the bottom plate 47B of the base 26. The flexible retaining device 14 is securely attached to the top center of the divider 24 via magnets 13A and 13B while the flat surface 12 is secured to the top of the base 26 via magnets 13B and 13C. The first flexible retaining device 14 may hold down two decks of cards, one on either side of the divider 24, via the weighted elements 16 and 18. The divider 24 may be removably attachable. In another embodiment, the divider 24 is permanently installed at the center of the card tray 100*a*. In one embodiment, 13C is a ferrous metal.

Figure 4A:
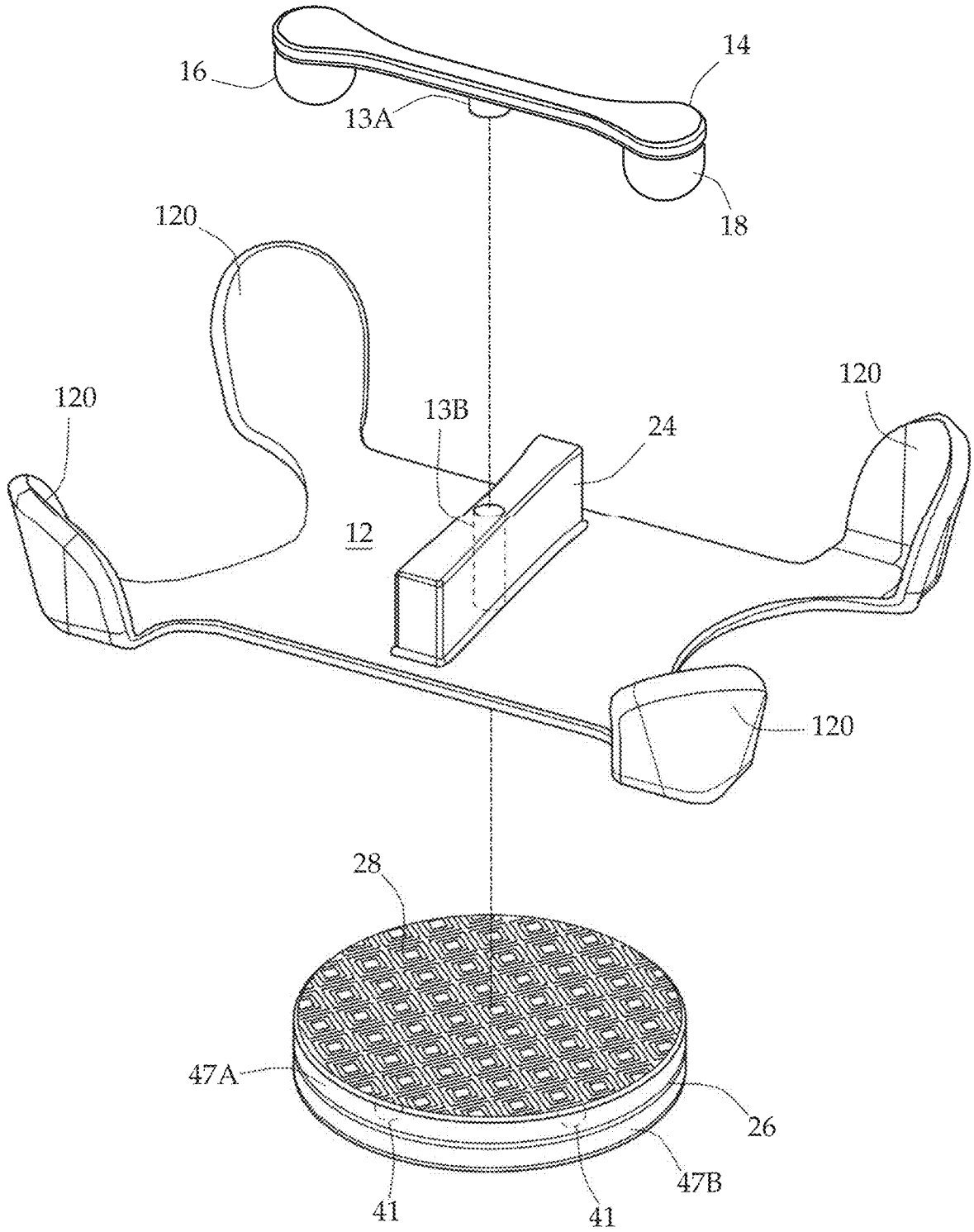
FIG. 4A is a schematic diagram showing an exploded view of the rotatable card caddy comprising a card tray and a rotatable base with the flexible retaining device.

FIG. 4A depicts a number of individual components disclosed in the card holding and playing system 10. In a preferred embodiment, the divider 24 has a non-magnetic hollow structure in the middle configured to accommodate magnet 13B, wherein the height of magnet 13B equals the height of the divider 24 such that magnets 13A and 13C are in contact with magnet 13B. In one embodiment, the base 26 is a clear acrylic Lazy Susan comprising steel ball bearings 41 with art work on a top 28, the magnet 13C embedded in the center of the top bearing plate 47A, and the bottom bearing plate 47B with a non-slip bottom. In another embodiment, the base 26 may be permanently affixed on the bottom of the card tray.

Figure 4B:
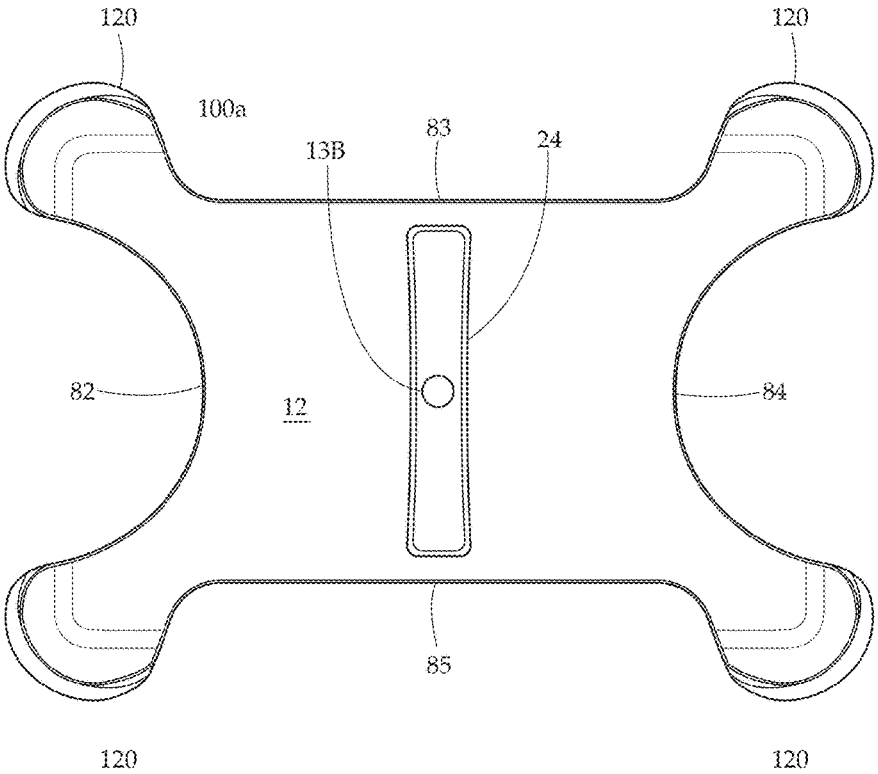
FIG. 4B is a schematic diagram showing a top view of the card tray with a divider.
Figure 4C:
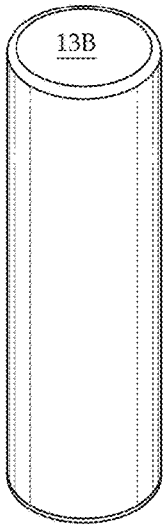
FIG. 4C is a schematic diagram of a ferrous metal or magnet located at the center of the divider.
Figure 4D:
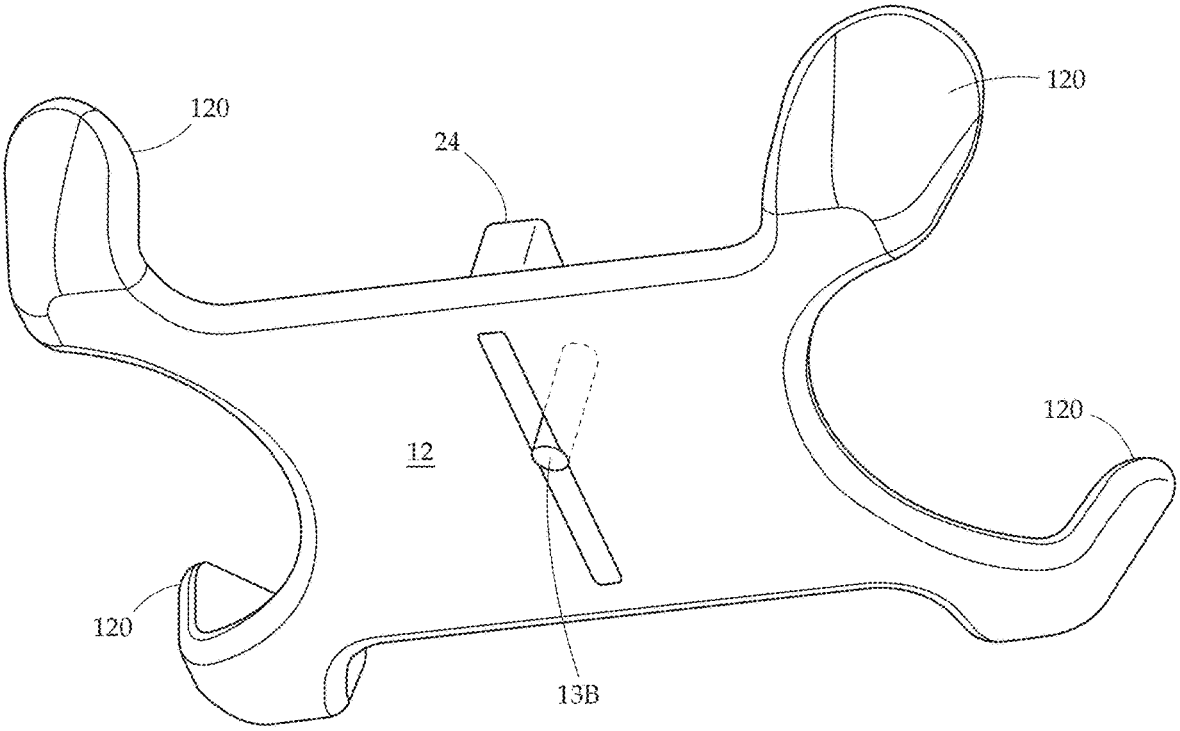
FIG. 4D is a schematic diagram showing a perspective view of the card tray.

FIG. 4B depicts a preferred embodiment of the rotatable card caddy 100 which comprises four vertical openings 82, 83, 84, and 85 on a peripheral next to the four corners 120. It also shows a preferred securing mechanism using a ferrous metal or magnet 13B to secure the flexible retaining device 14 and the rotatable base 26 to the top of the divider 24 and to the bottom of the flat surface 12 of the card tray 100*a*, respectively. The cylindrical magnet 13B, which may alternatively be a ferrous metal, is shown in FIG. 4C. It is exposed on the top of the divider 24 and the bottom of the flat surface 12 as shown in FIGS. 4A and 4D. In another embodiment, the magnet 13B is encased in a thin layer of material at its north and/or south ends. The card tray 100*a* is held in position on the rotatable base 26 via a south end of the magnet 13B and a north end of magnet 13C in the top bearing plate 47A of the base 26.

Figure 5A:
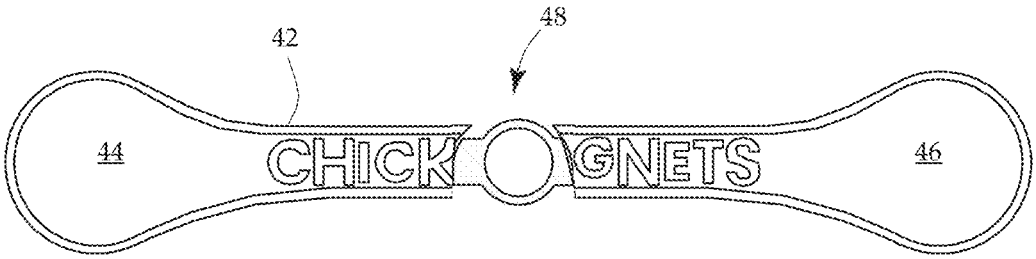
FIGS. 5A-5B are schematic diagrams showing the flexible retaining device with a spherical weight on either end of the device.
Figure 5B:
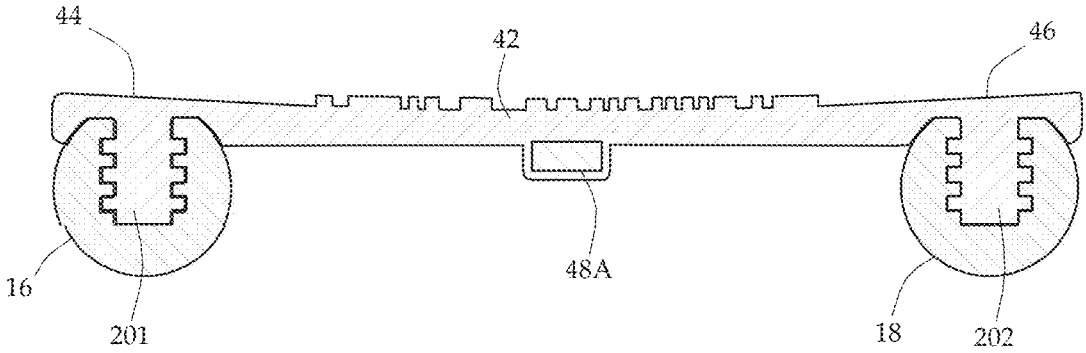

FIGS. 5A and 5B show a preferred embodiment of the flexible retaining device 14, wherein the flexible retaining device 14 comprises an arm 42 and a magnet 48A encapsulated in a broken-out section 48 at a middle portion of the arm 42. The arm 42 is held in position via the magnet 48A and a ferrous surface, such as the north end of the magnet 13B in the divider 24 or a game plate 300. Additionally, in a preferred embodiment, the weighted elements 16 and 18 are attached to the arm 42 by securing them onto two male members 201 and 202 having annular grooved heads formed on their outer surface. The male members 201 and 202 are configured outwardly and downwardly near the ends 44 and 46.

Figure 5C:
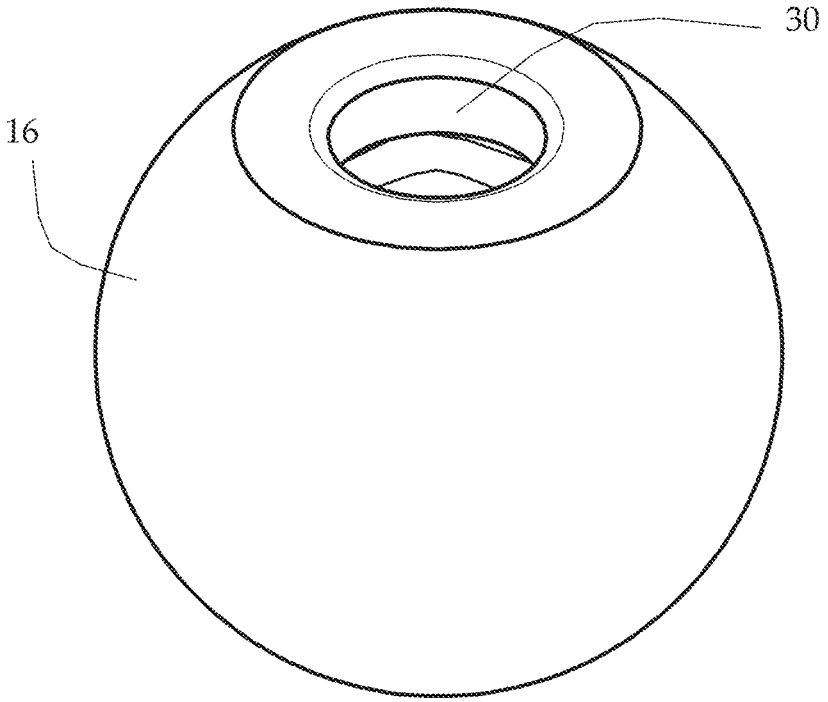
FIGS. 5C-5D are schematic diagrams of the spherical weight with internal annular grooves.
Figure 5D:
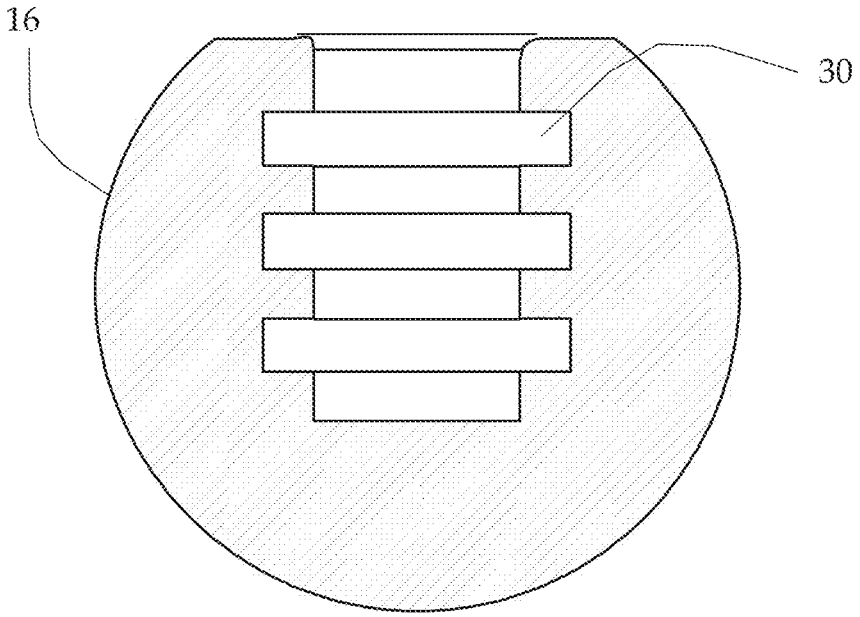

FIGS. 5C and 5D illustrate a preferred embodiment of the weighted elements 16 and 18 which is configured to have a female member 30 having annular grooves internally. The weighted elements 16 and 18 are substantially non-ferrous and spherical with a relatively flat top allowing them to be secured against the arm 42 tightly. Alternatively, the weighted elements 16 and 18 are selected from any one of a hollow sphere, a hollow semi-sphere, a hollow ellipse sphere, and a hollow semi-ellipse sphere. In some embodiments, the weighted elements are permanently fixed to the flexible retaining device. In other embodiments, the weighted elements are removably attached to the two ends of the flexible retaining device. In yet another embodiment shown in FIG. 5H, the weighted elements 16 and 18 have atop flange 501 on which the arm 42 is additionally secured.

Figure 5E:
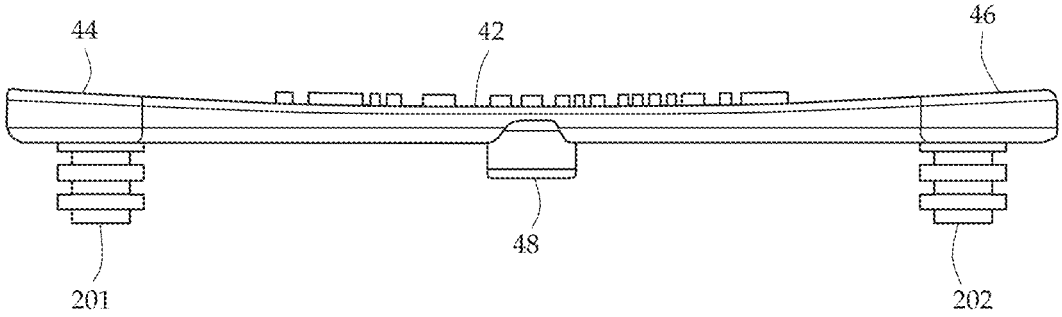
FIG. 5E is a schematic diagram showing a side view of the flexible retaining device without the spherical weights.
Figure 5F:
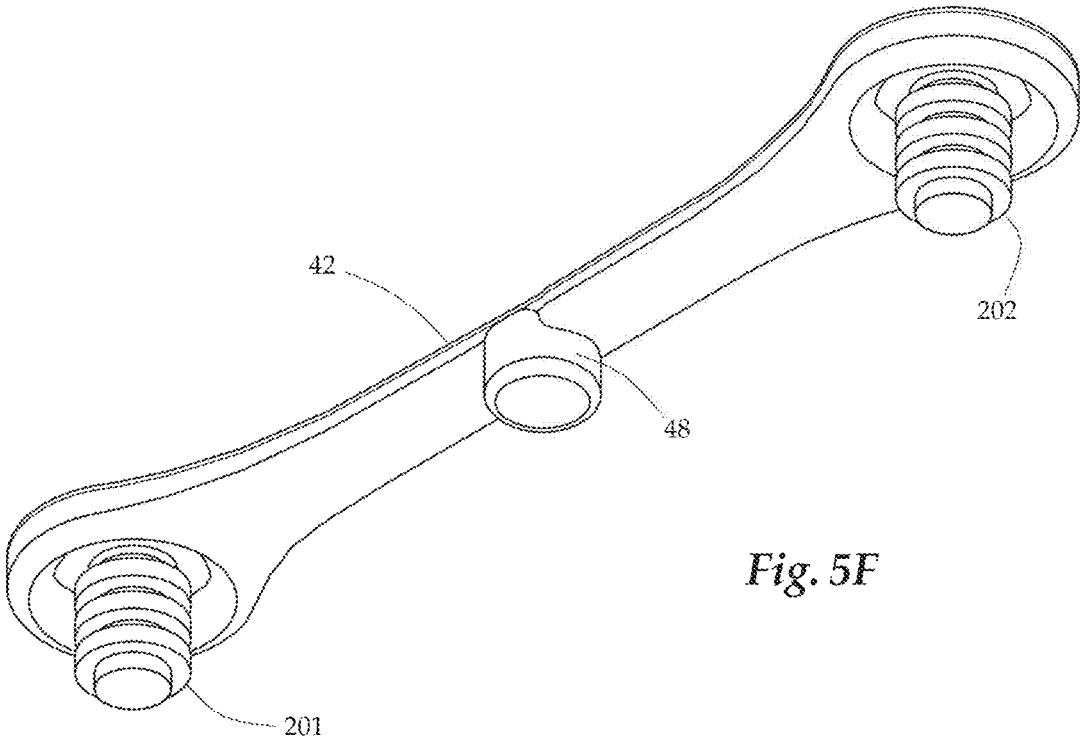
FIG. 5F is a schematic diagram showing a perspective view of the flexible retaining device without the spherical weights.
Figure 5G:
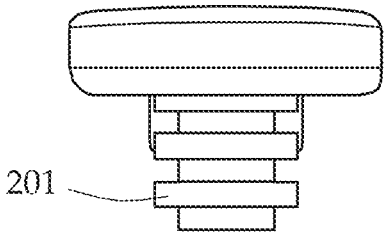
FIG. 5G is a schematic diagram showing a side view of a groove head fixedly attached to either end of the flexible retaining device.
Figure 5H:
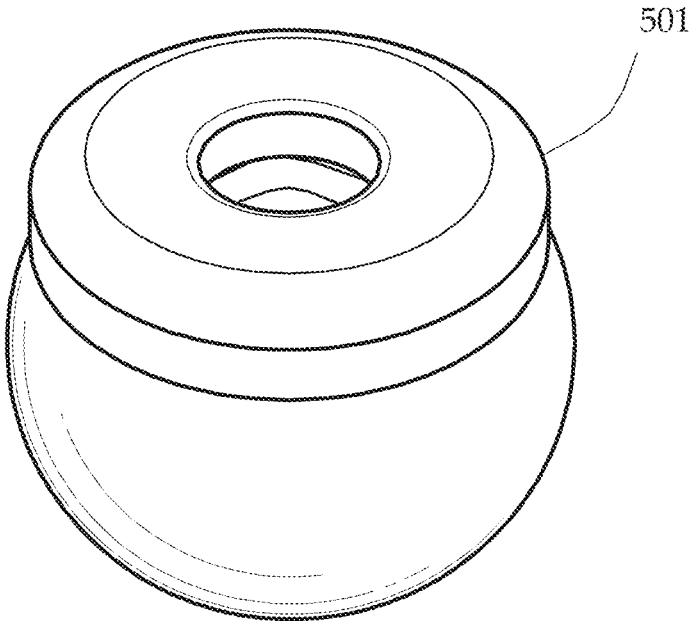
FIG. 5H is a schematic diagram showing an alternate embodiment of one of the spherical weights with a flange.

In one embodiment, male members 201 and 202, ends 44 and 46, and arm 42 comprise a singular unit as shown in FIGS. 5E-5G. In another embodiment, the male members 201 and 202 are removable such that a user may replace the ends 44 and 46 with male members of different diameters to accommodate heavier and/or lighter weighted elements. In some embodiments, male members 201 and 202 may be silicone, TPE, metal, or plastic composite.

Figure 6A:
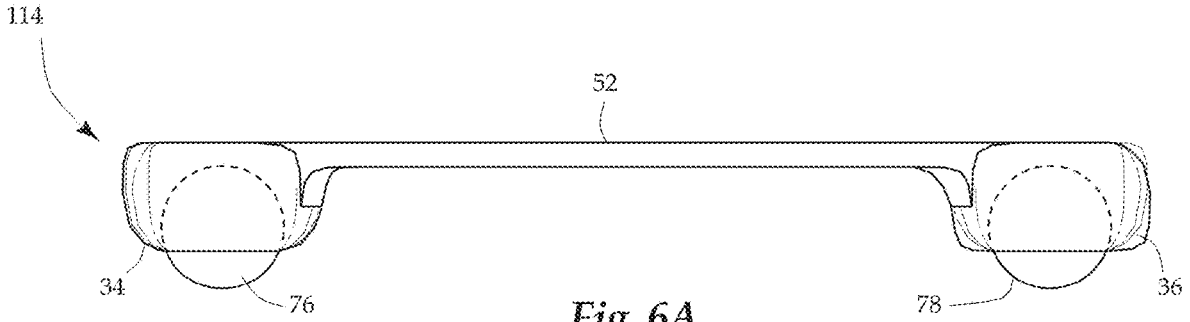
FIGS. 6A-6B are schematic diagrams showing another flexible retaining device.
Figure 6B:
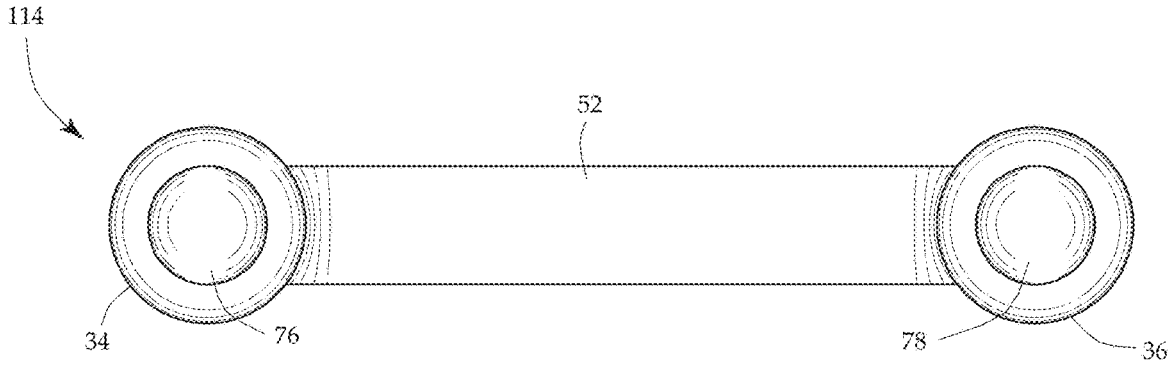

Another embodiment 114 of the flexible retaining device, as shown in FIGS. 6A and 6B comprises an arm 52 and two flanges 34 and 36. The flanges 34 and 36 hold the weighted elements 76 and 78 and preferably extend beyond the halfway point of each weighted element 76 and 78. In one embodiment, the flanged areas 34 and 36 that hold the weighted elements 76 and 78 in place has a chamfer so that each weighted element 76 and 78 can stay in contact with a card stack as the height of the stack increases or decreases.

Figure 7A:
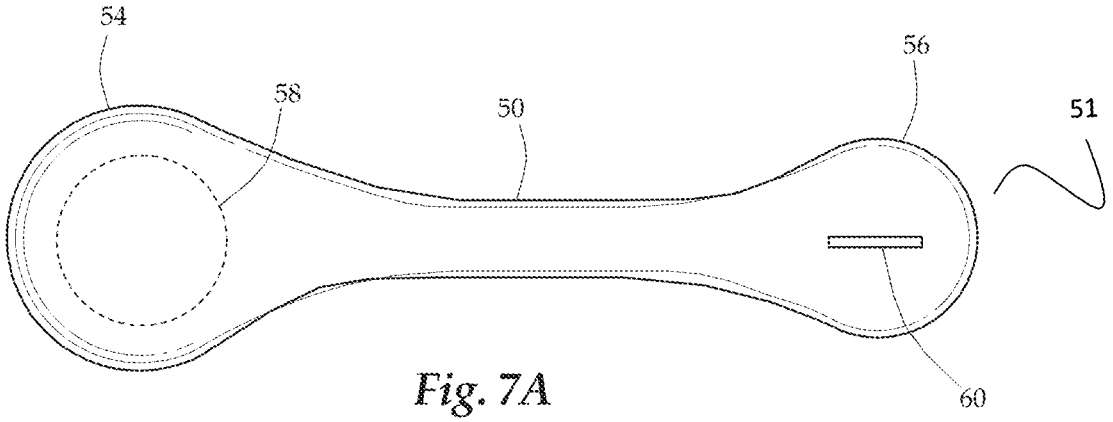
FIGS. 7A-7D and 8A-8B are schematic diagrams showing asymmetrical flexible retaining devices with a single weighted element.
Figure 7B:
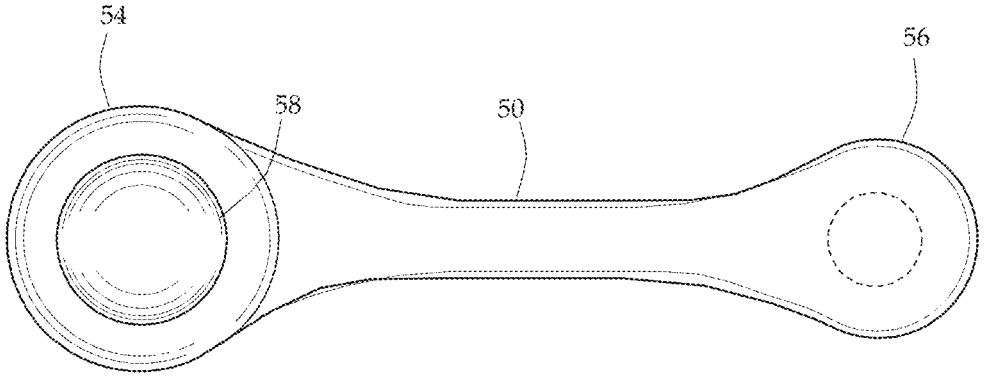

FIGS. 7A and 7B illustrate one embodiment of another flexible retaining device 51 with two asymmetrical ends. In this embodiment, a first end 56 possesses a smaller circumference and a slit 60 to allow for the insertion of a magnetic element. A second end 54 possesses a larger circumference in relation to the first end 56 and contains a weighted element 58. In this configuration, the arm 50 is preferably made of silicone or TPE. Light magnetism and a low friction underside allow the flexible retaining device 51 to easily slide over cards with gentle, one-handed pull/push manipulation. Additionally, FIGS. 7C-7D and 8A-8B illustrate other embodiments of an asymmetrical flexible retaining device 51 with one weighted element.

In one embodiment, the flexible retaining device 51 preferably comprises a large circumference in one end and a small circumference in the other end, wherein a weighted element in the shape of a sphere or hemisphere is exposed at the end with the larger circumference; and a magnet element is completely or partially encapsulated at the end with the smaller circumference.

Figure 7C:
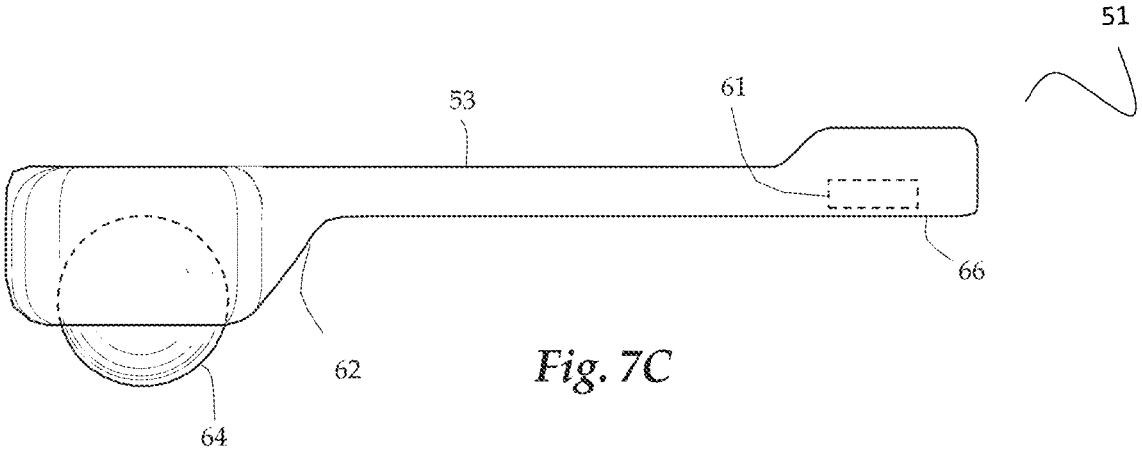
Figure 7D:
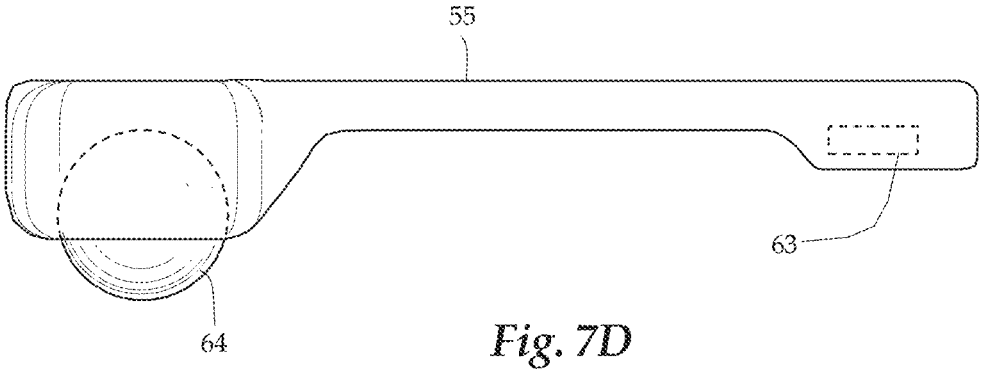

In a preferred embodiment as shown in FIGS. 7C and 7D, magnetic elements 61 and 63 are completely encapsulated at the end with the smaller circumference. Alternatively, the magnets 61 and 63 are partially encapsulated; in yet another alternative element, the magnet element 61 and 63 may be constructed of a variety of shapes, including spherical, cubical, trapezoidal or any similar design.

In one embodiment, the weighted element 58 is a partially exposed weighted ball 64 which is held in place by a flange with a chamfered area 62 so that the weighted ball stays in contact with a card stack as the height of the stack increases or decreases. The bottom of weighted ball 64 and the bottom of arm 53 and 55 are slippery enough to allow the retaining device to easily slide over cards.

In one embodiment, the end with a smaller circumference has a flat bottom 66 with a slippery finish. In another embodiment, the top side of arm 55 is flush.

Figure 8A:
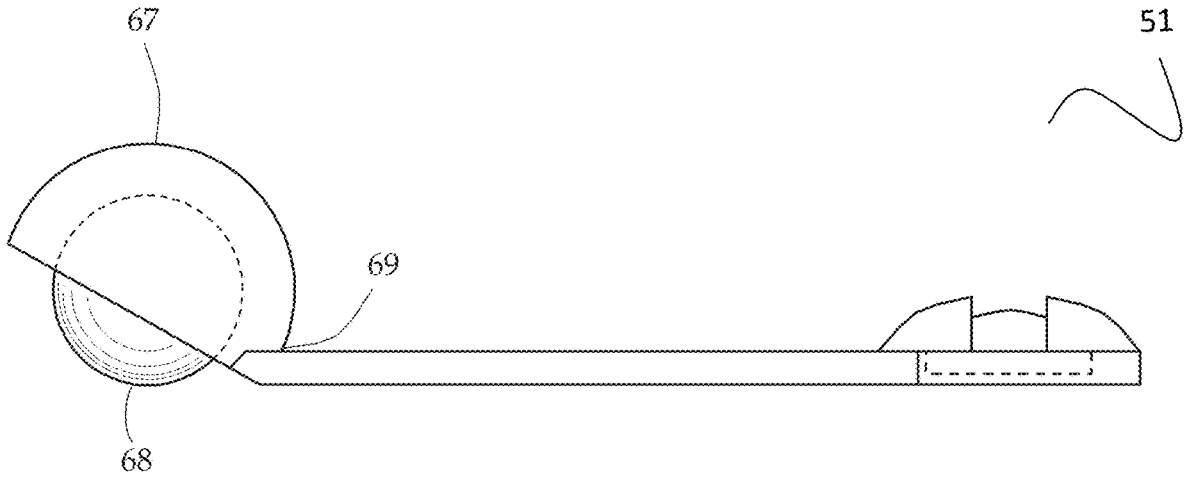
Figure 8B:
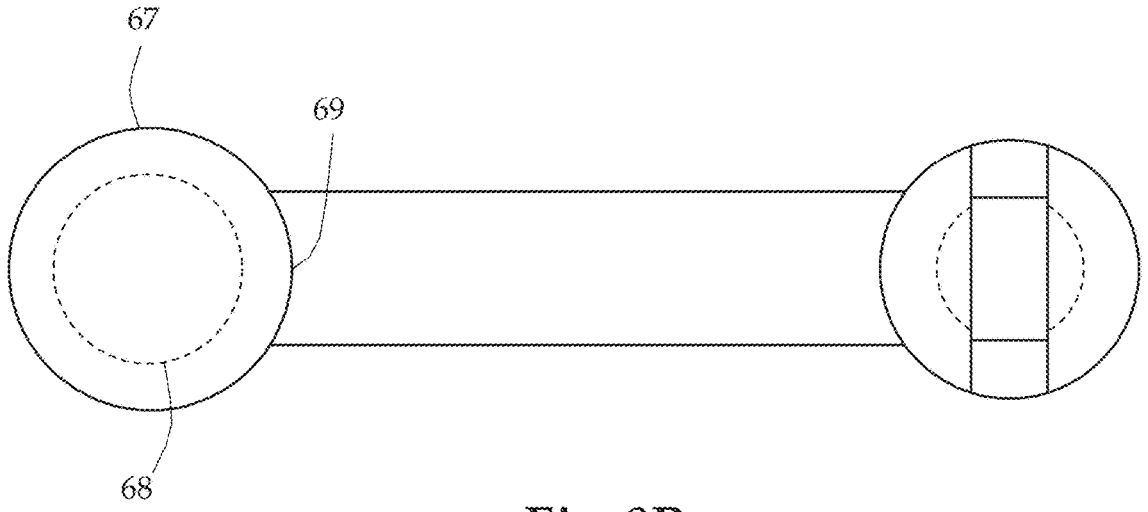

In another embodiment of a flexible retaining device as shown in FIGS. 8A and 8B, the device has two asymmetrical ends. The end 67 with a partially exposed weighted ball 68 rotatably bends at joint 69 as the height of a card stack increases or decreases.

Figure 9A:
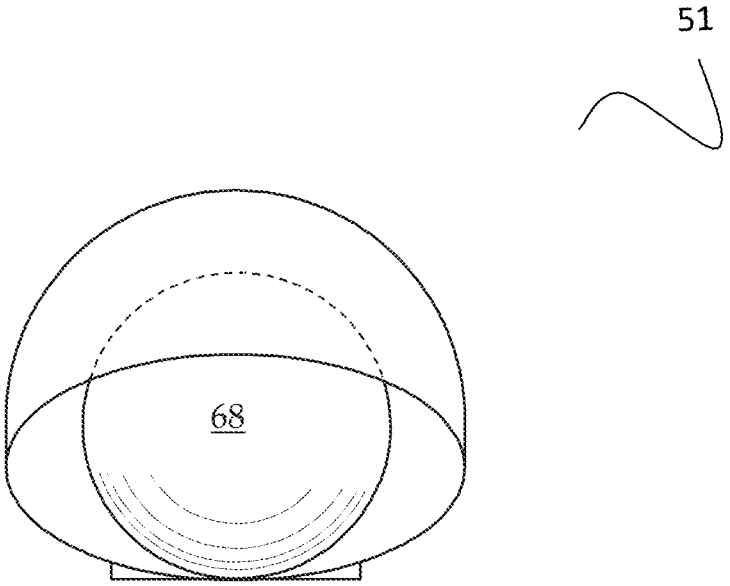
FIG. 9A is a schematic diagram showing a spherical weight partially exposed at one end of the retaining device depicted in FIG. 8A.
Figure 9B:
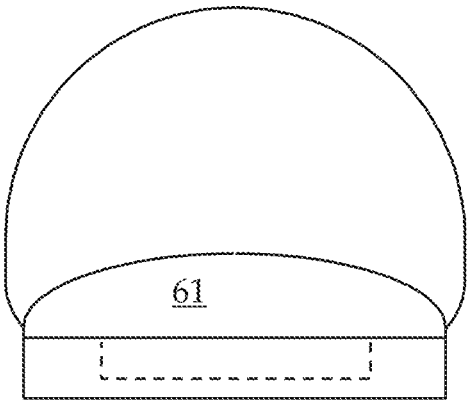
FIG. 9B is a schematic diagram showing a magnet element encapsulated in one end of the retaining device depicted in FIG. 8A.

FIG. 9A illustrates a schematic diagram showing one end of the flexible retaining device 51 with a partially exposed weighted ball 68. FIG. 9B illustrates a schematic diagram showing the other end with an encapsulated magnetic element 61 and a flat bottom.

Figure 10A:
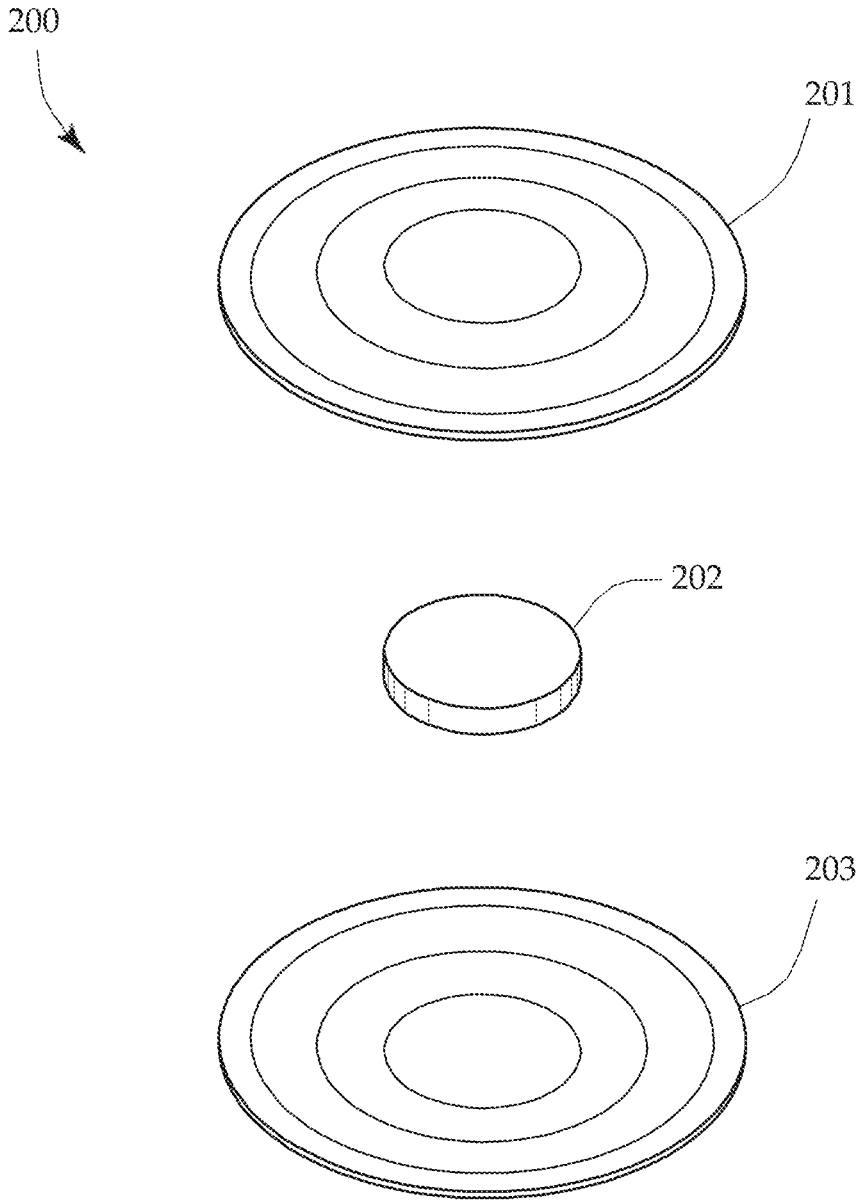
FIG. 10A is a schematic diagram showing an exploded view of the retaining disc.

FIG. 10A shows a perspective view of a portable, movable, and stackable retaining disc 200 with magnet 202 encased in a top portion 201 and a bottom portion 203. The top portion 201 and the bottom portion 203 are made of low friction, heat resistant, semi-flexible or rigid material.

Figure 10B:
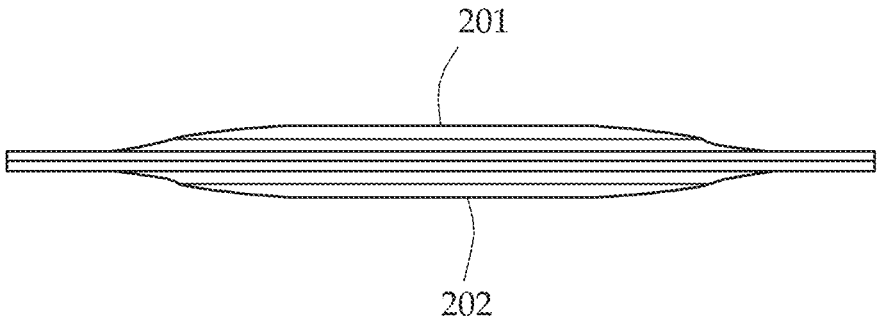
FIG. 10B is a schematic diagram showing a side view of the retaining disc.

FIG. 10B shows a side view of the retaining disc 200 demonstrating top and bottom symmetry with a heat seal or molded edge preferably centered vertically so that the disc is reversible. An air gap at the edge of the retaining disc 200, together with the low friction, semi-flexible and/or rigid material of top 201 and bottom 203, allow for ease of card insertion and removal while the retaining disc remains attached to a ferrous surface, enabling one-handed play. The retaining disc 200 may slide easily along cards and/or the game plate with gentle pull/push manipulation or the retaining disc may be picked up and moved around freely.

Figure 10C:
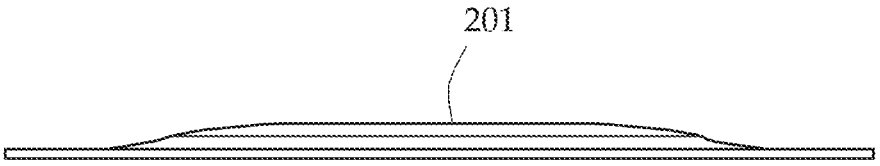
FIGS. 10C-10D are schematic diagrams showing side views of the top and bottom parts of the retaining disc.
Figure 10D:
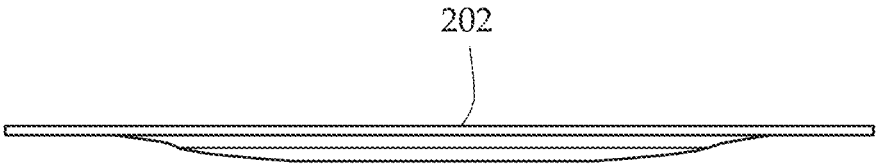

In one embodiment as shown in FIGS. 10B-10D, the top portion 201 and the bottom portion 203 are flat in the middle so that the number of cards held can be expanded by vertically stacking cards and the retaining discs in an alternating manner. For example, stacks of completed melds or tricks can be secured in this way. The size of the flat area of top 201 and bottom 203 may vary based on a specific desire of contact area and holding power of the retaining disc 200 related to the size of encased magnet 202 and the volume of cards needed to be held in position. The preferred embodiment is an encased magnet 202 with a low pull force that is strong enough to hold 13+ stacked cards on a horizontal playing surface. At the same time, the pull force is low enough for a user to easily separate an individual retaining disc from a stack of retaining discs. In another embodiment, each retaining disc 200 additionally encases an outer ring of lightweight filler, such as foam, that surrounds magnet 202. A plurality of retaining discs 200 naturally stack into a compact column for storage, attracted by their magnetic force.

Figure 11A:
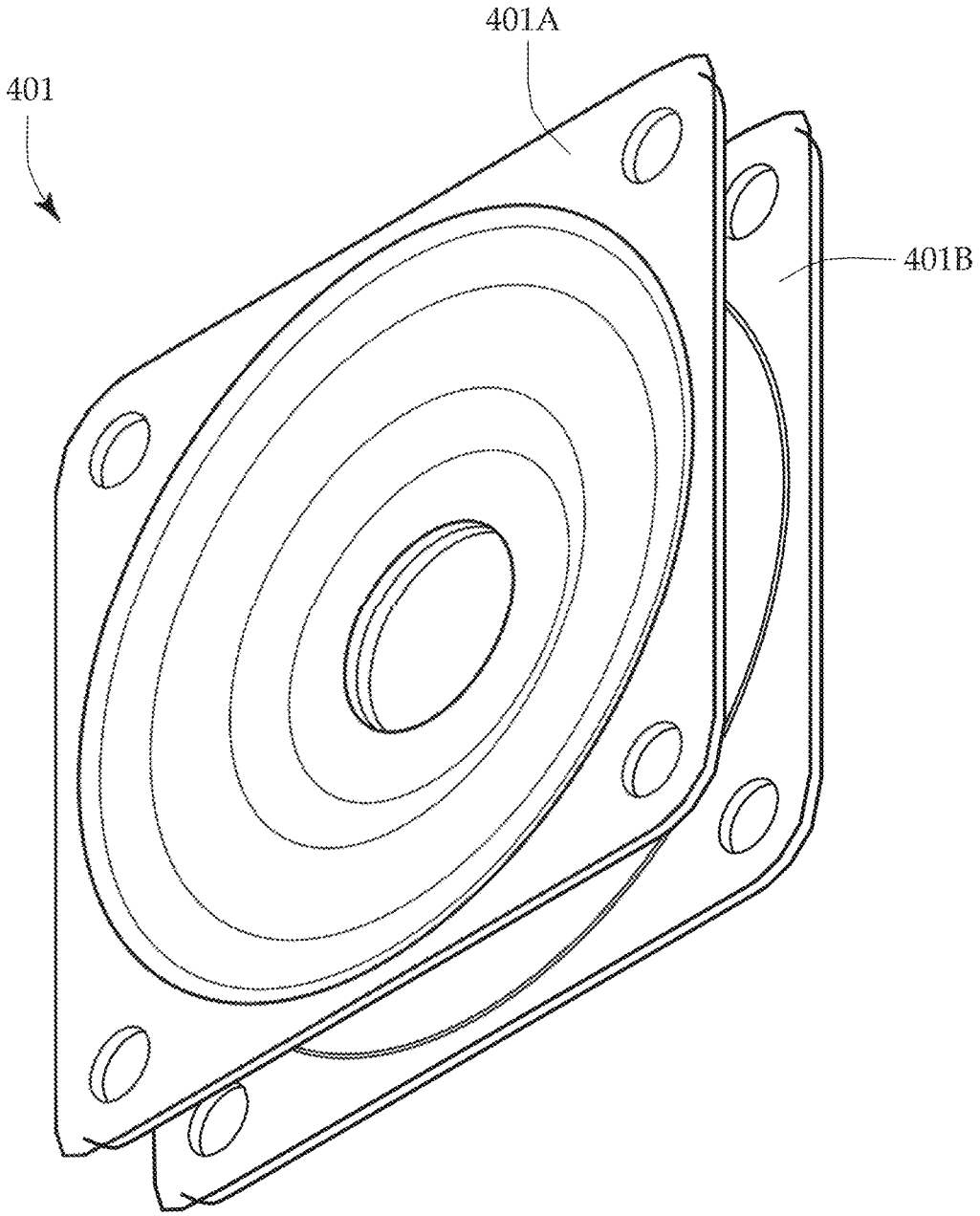
FIG. 11A is a schematic diagram showing a perspective view of a bearing plate for the base of the rotatable card caddy.
Figure 11B:
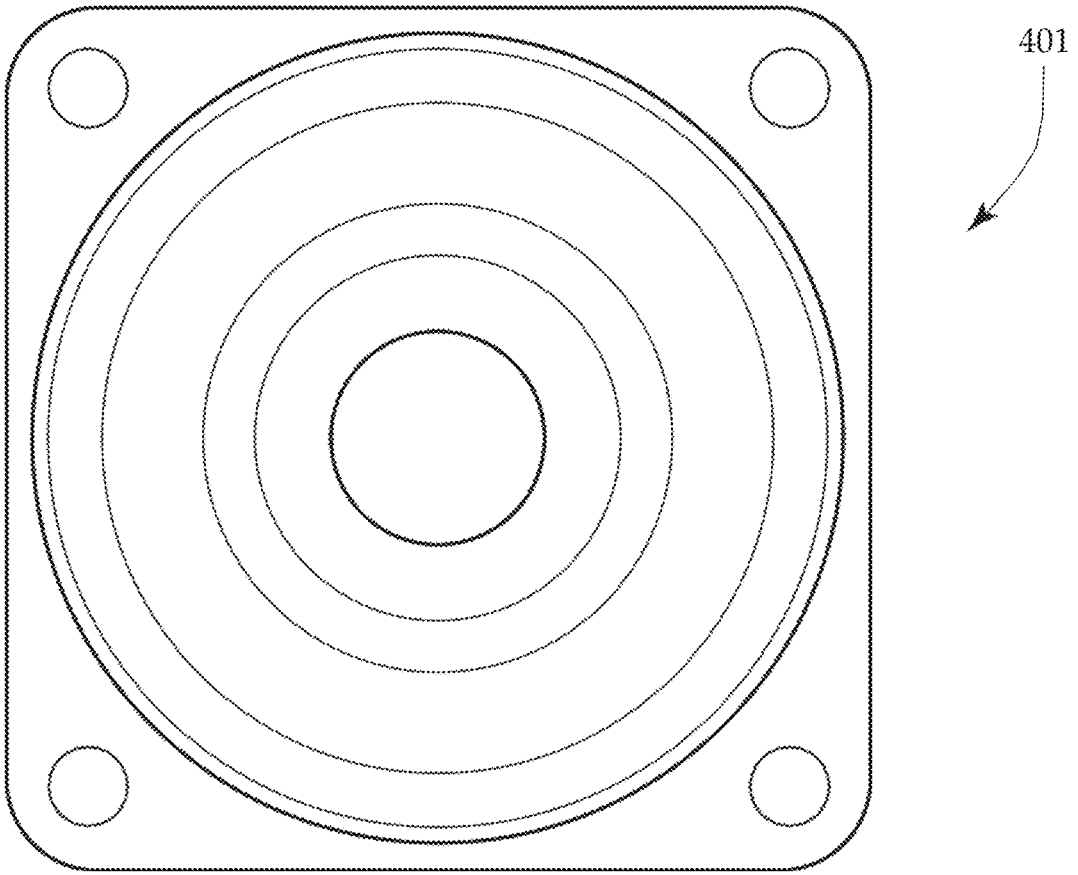
FIG. 11B is a schematic diagram showing a top view of the bearing plate for the base of the rotatable card caddy.
Figure 11C:
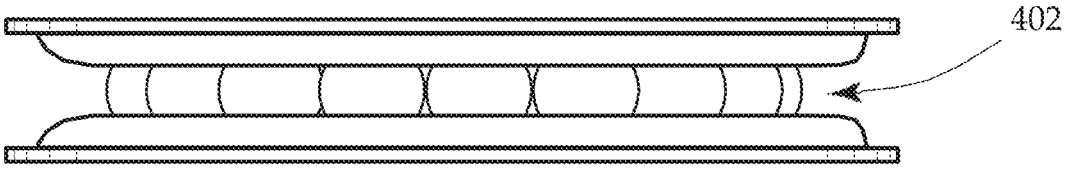
FIG. 11C is a schematic diagram showing a side view of the bearing plate for the base of the rotatable card caddy containing bearing balls inside.

FIGS. 11A-11C show an alternative embodiment of a bearing assembly 401 comprising two square bearing plates 401A and 401B and a plurality of bearing balls 402. In an alternate embodiment of the base 26, bearing plate 401A is fixedly attached to receiving grooves in top bearing plate 47A while 401B is fixedly attached to receiving grooves in bottom bearing plate 47B.

Figure 12:
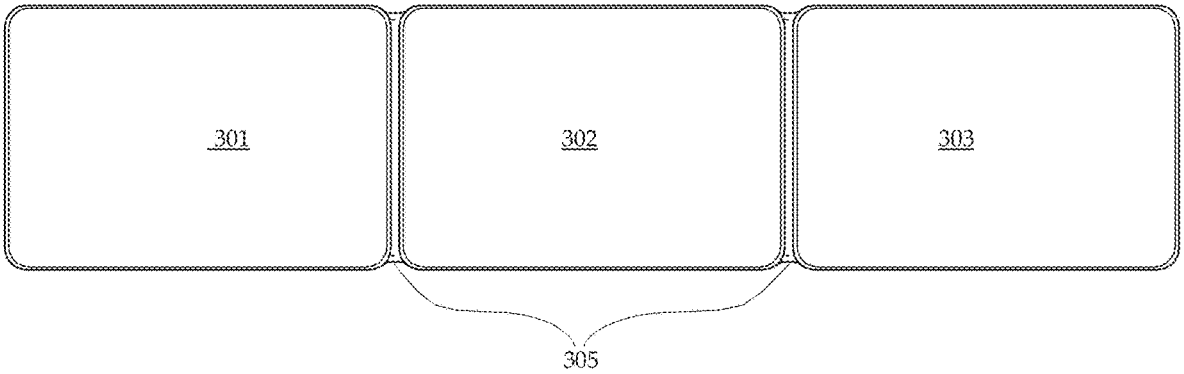
FIG. 12 is a schematic diagram showing multi-layer game plates with a ferrous core encased in a laminate material with living hinges to accommodate the folding mechanism wherein a plurality of games plates is connected.
Figure 13:
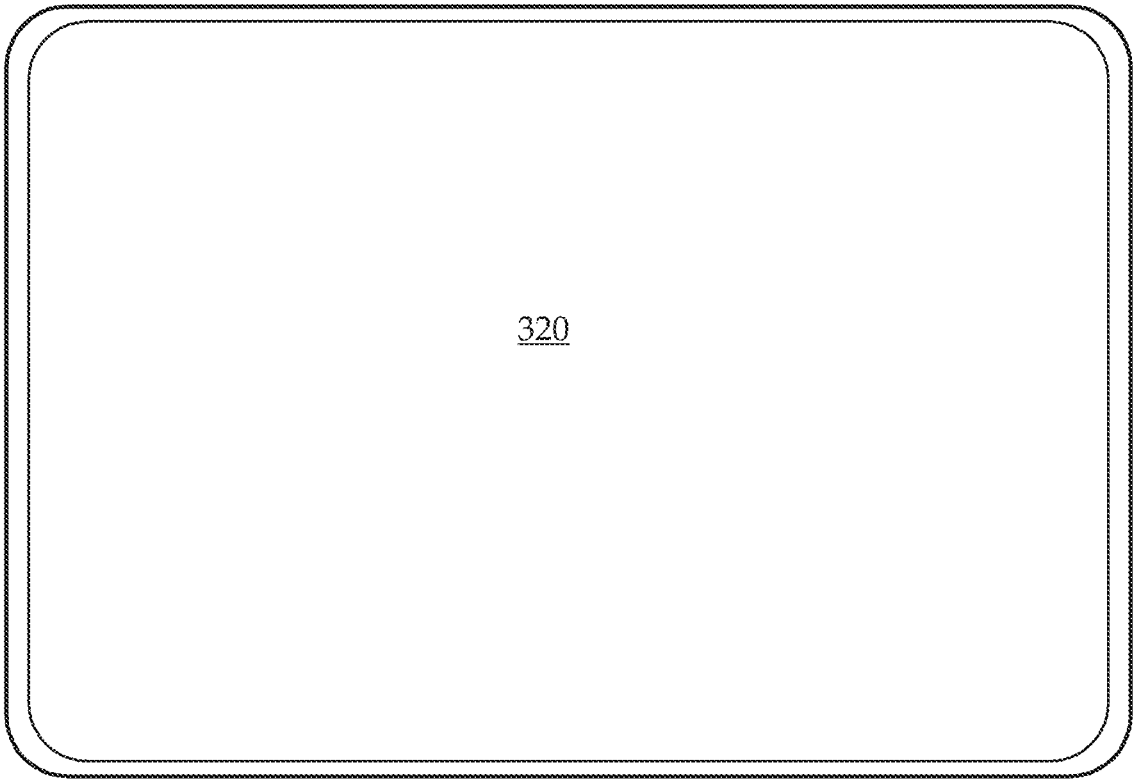
FIG. 13 is a schematic diagram showing a single game plate with a ferrous core encased in a laminate material.

FIGS. 12 and 13 illustrate schematic diagrams of trifold 300 and single 320 game plates with a core made of lightweight substantially ferrous metal preferably with a thickness between 0.005 and 0.02 inches and galvanized or otherwise protected from rust. In a preferred embodiment, the game plates are sized to fit into the card tray 100*a* resting on and magnetically attracted to the north end of magnet 13B located in divider 24.

In one embodiment as shown in FIG. 12, the trifold game plate 300 is laminated or otherwise covered in durable and lightweight materials or a combination of materials such as vinyl or Tyvek. The underside of the game plate 300 has a gripping material or coating so that the plates 301, 302, and 303 do not slide on a surface. The top of the game plate 300 has a low friction laminate surface or may alternatively be powder coated, galvanized, plated, or painted. The trifold game plate 300 comprises three separate metal sheets 301, 302, and 303. In this embodiment, each plate is connected to the next corresponding plate via a glued and/or heat sealed top and bottom laminate with living hinges 305. Alternatively, the game plate can be utilized individually as a single game plate 320 with a ferrous core encased in a laminate material as shown in FIG. 13 or powder coated, galvanized, plated or painted and with a gripping material or coating on its underside.

Figure 14A:
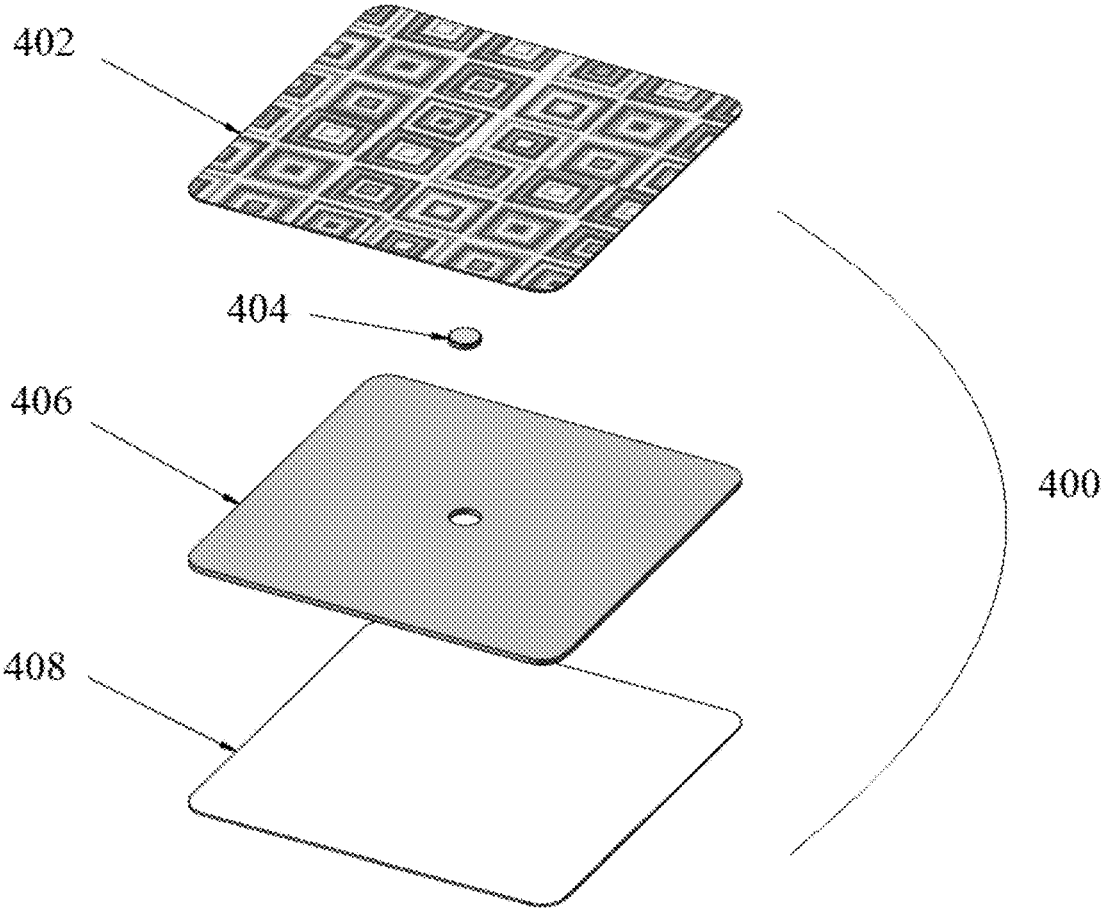
FIG. 14A-14B is an alternate embodiment of the base of the card holding and playing system with the base having a magnet embedded within three layers.
Figure 14B:
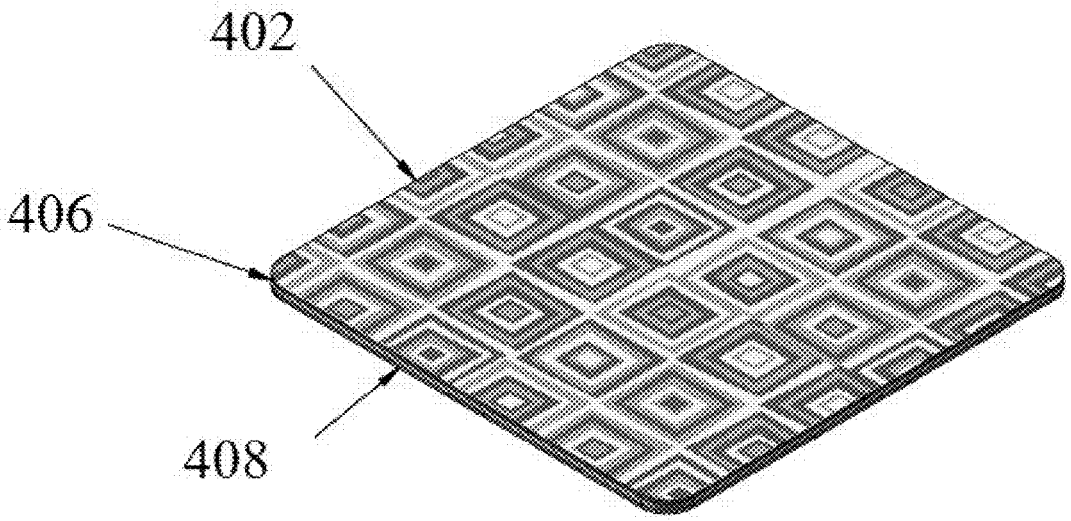

FIGS. 14A and 14B illustrate an alternate embodiment of the base 26 for the card holding and playing system, wherein a base 400 is shown having a top layer 402, a middle layer 406 and a bottom layer 408. In this embodiment, a magnet 406 is contained with the middle layer 404 and surrounded by the top layer 402 and bottom layer 408. In another embodiment, the top layer 402 possess a low friction finish, and the bottom layer 408 possesses a high friction finish so that the base 400 does not slide on a surface where the card holding and playing system is located. In this embodiment, the flat surface 12 of the card tray 100*a* is secured to the base 26 via magnets 13B and 13C. The magnet 13B in the card tray 100*a* pivots about the magnet 13C or 404 (depending on the embodiment) to allow rotation of the card tray 100*a*.

FIGS. 15A and 15B illustrate the card tray 100*a* and the base 400, wherein during play, the base 400 is located below the card 100*a* and during storage, the base 400 is stored within the card tray 100*a* resting on the divider 24.

It should be understood that various alternatives to the embodiments of the disclosure described herein may be employed in practicing the disclosure. Elements of an implementation of the kit described herein may be independently implemented or combined with other implementations.

What is claimed is:

1. A card holding and playing system comprising:
a card caddy;
a flexible retaining device;
a plurality of retaining discs; and
a plurality of game plates;
wherein the card caddy further comprises:
a card tray;
a divider; and
a base, wherein the base comprises a top layer with a low friction finish, a middle layer with a magnet and a bottom layer with a high friction finish;
wherein the flexible retaining device further comprises:
an elongated flexible arm comprising a first end and a second end;
a first weighted element disposed to the first end;
a second weighted element disposed to the second end; and
a receiving element disposed downwardly in the flexible arm; and
wherein each of the retaining discs further comprises at least one magnet embedded inside the retaining disc to retain a plurality of cards in position on a game plate of the plurality of game plates.

2. The card holding and playing system of claim 1, wherein the divider includes a ferrous metal or magnetic rod to receive the flexible retaining device and the base.

3. The card holding and playing system of claim 1, wherein a top center of the divider comprises a friction fit element in order to secure the flexible retaining device.

4. The card holding and playing system of claim 1, wherein a top center of the divider comprises a snap fit element in order to secure the flexible retaining device.

5. The card holding and playing system of claim 1, wherein the first weighted element is fixedly attached to the first end and the second weighted element is fixedly attached to the second end of the flexible retaining device.

6. The card holding and playing system of claim 1, wherein the first weighted element is removably attached to the first end and the second weighted element is removably attached to the second end of the flexible retaining device.

7. The card holding and playing system of claim 1, wherein the card caddy further comprises: a first magnet embedded in the divider to secure the flexible retaining device and the base; a second magnet embedded at a top of the base; and a third magnet disposed downwardly in the middle of the elongated flexible arm; wherein the first magnet, the second magnet, and the third magnet are arranged to magnetically attract each other to secure the flexible retaining device, the card tray, and the base together.

8. The card holding and playing system of claim 1, wherein the flexible retaining device further comprises a first male member with an annular grooved head configured outwardly and downwardly at the first end to accommodate the first weighted element, and a second male member with an annular grooved head configured outwardly and downwardly at the second end to accommodate the second weighted element.

9. The card holding and playing system of claim 8, wherein the first and the second weighted elements have a low friction surface and each weighted element is configured to have a female member having annular grooves internally such that the first and the second weighted elements are securely fastened at the first and the second ends respectively.

10. The card holding and playing system of claim 9, wherein the first and the second weighted elements each further comprises a flange located at a top of each weighted element to accommodate and provide better adhesion to the first end and the second end of the retaining device respectively.

11. The card holding and playing system of claim 1, wherein a shape of the first and the second weighted elements is selected from a group consisting of a sphere, a semi-sphere, an ellipse sphere, and a semi-ellipse sphere.

12. The card holding and playing system of claim 1, wherein the card tray is configured to bevel outward and further comprises four corners and a plurality of openings in between adjacent corners along a peripheral of the card tray.

13. The card holding and playing system of claim 1, wherein the base is rotatable and comprises: a top plate; a bottom plate; and a plurality of bearing balls; wherein the bottom plate comprises a grippy bottom; and wherein the bearing balls swivel freely to enable circular motions of the top plate relative to the bottom plate while the bottom plate remains motionless.

14. The card holding and playing system of claim 1, wherein the elongated flexible arm comprises a first flange at the first end to house the first weighted element and a second flange at the second end to house the second weighted element.

15. The flexible retaining device of claim 1, wherein the first end of the flexible arm has a weighted element configured to retain cards and the second weighted element of the second end of the flexible arm is configured to secure the flexible retaining device onto a ferrous surface.

16. The card holding and playing system of claim 1, wherein the plurality of game plates each comprises a top layer with a low friction finish, a middle layer with a lightweight ferromagnetic core, and a bottom layer with a high friction finish so that the game plates do not slide on a surface.

17. The card holding and playing system of claim 16, wherein the plurality of game plates each comprises a plurality of foldable and interconnected subplates connected by laminated materials with living hinges.

18. The card holding and playing system of claim 16, wherein the plurality of game plates stack inside a plurality of corners of the card tray resting on and magnetically attracted to the divider.

19. The card holding and playing system of claim 1, wherein a top portion and a bottom portion of each of the plurality of retaining discs are symmetrical and reversible with an air gap located at a peripheral of the retaining discs made of low friction material to allow for ease of card insertion and removal.

20. The card holding and playing system of claim 1, wherein the plurality of retaining discs are flat in a middle so that a number of cards held can be expanded by stacking the plurality of retaining discs vertically to hold a stack of cards in between each adjacent retaining disc and the plurality of retaining discs magnetically attract into a compact column for storage.

21. The card holding and playing system of claim 1, wherein a base is rotatable and stacks inside a plurality of corners of the card tray resting on and magnetically attracted to the divider.

* * * * *